US007174583B2

(12) United States Patent
Hofmann

(10) Patent No.: US 7,174,583 B2
(45) Date of Patent: Feb. 13, 2007

(54) ADJUSTABLE HEIGHT FOUNDATION

(75) Inventor: Don Hofmann, Atlanta, GA (US)

(73) Assignee: Dreamwell Ltd., Las Vegas, NV (US)

( * ) Notice: Subject to any disclaimer, the term of this patent is extended or adjusted under 35 U.S.C. 154(b) by 158 days.

(21) Appl. No.: 10/985,622

(22) Filed: Nov. 10, 2004

(65) Prior Publication Data

US 2005/0120478 A1 Jun. 9, 2005

Related U.S. Application Data

(63) Continuation-in-part of application No. 10/617,946, filed on Jul. 11, 2003, now Pat. No. 7,017,205.

(60) Provisional application No. 60/395,449, filed on Jul. 11, 2002, provisional application No. 60/518,913, filed on Nov. 10, 2003.

(51) Int. Cl.
*A47C 19/04* (2006.01)

(52) U.S. Cl. ..... 5/400; 5/200.1

(58) Field of Classification Search ..... 5/400, 5/200.1, 201

See application file for complete search history.

(56) References Cited

U.S. PATENT DOCUMENTS

| | | | | |
|---|---|---|---|---|
| 1,866,953 A | | 7/1932 | Stephens | 5/308 |
| 2,827,952 A | | 3/1958 | Propst | 267/103 |
| 2,908,918 A | | 10/1959 | Hopkes, Jr. | 5/200.1 |
| 3,049,729 A | | 8/1962 | Broyles | 5/200.1 |
| 3,083,380 A | | 4/1963 | Adler | 5/727 |
| 3,754,289 A | | 8/1973 | Larkin | 5/201 |
| 3,768,106 A | | 10/1973 | Fitzgerald | 5/131 |
| 3,950,797 A | * | 4/1976 | Bronstien, Jr. | 5/200.1 |
| 3,994,033 A | | 11/1976 | Bendell | 5/202 |
| 4,053,957 A | * | 10/1977 | Regan | 5/727 |
| 4,103,375 A | | 8/1978 | Santo | 5/675 |
| 4,128,907 A | | 12/1978 | Gelbart | 5/200.1 |
| 4,161,045 A | * | 7/1979 | Regan | 5/728 |
| 4,235,472 A | * | 11/1980 | Sparks et al. | 297/392 |
| 4,476,595 A | | 10/1984 | Ikeda | 5/721 |
| 4,583,254 A | | 4/1986 | Johenning | 5/682 |
| 4,597,120 A | | 7/1986 | Fogel | 5/685 |

(Continued)

FOREIGN PATENT DOCUMENTS

DE 29517817 1/1996

(Continued)

*Primary Examiner*—Robert G. Santos
(74) *Attorney, Agent, or Firm*—Fish & Neave IP Group Ropes & Gray LLP

(57) ABSTRACT

A height-adjustable mattress assembly is constructed of a mattress foundation and an optional frame assembly with a plurality of ground support members supporting the mattress foundation. The ground support members can be attached to the frame assembly in at least two orientations so as to maintain the top surface of the foundation above ground in a substantially horizontal orientation at at least two different heights. The mattress foundation can be made of two mattress foundation members that are spaced apart by spacer members. The mattress foundation members can be oriented with respect to each other so as to provide a combined height that is adjustable. By combining the adjustable ground support members with the assembly having two mattress foundation members, adjustment at three or more different heights is possible.

14 Claims, 7 Drawing Sheets

U.S. PATENT DOCUMENTS

| | | | | |
|---|---|---|---|---|
| 4,602,396 | A | 7/1986 | Fraige | 5/668 |
| 4,617,689 | A | 10/1986 | Nelson et al. | |
| 4,662,015 | A | 5/1987 | Galumbeck | 5/504.1 |
| 4,734,946 | A | 4/1988 | Saputo | 5/400 |
| 4,759,088 | A | 7/1988 | Brown | 5/401 |
| 4,774,733 | A | 10/1988 | Akers | 5/679 |
| 4,870,711 | A | 10/1989 | Felix | |
| 4,878,259 | A | 11/1989 | Lupo | 5/675 |
| 5,095,560 | A | 3/1992 | Volker et al. | 5/11 |
| 5,099,529 | A | 3/1992 | Anderson | 5/400 |
| 5,136,740 | A | 8/1992 | Draft | 5/730 |
| 5,161,271 | A | 11/1992 | Gronbach | 5/668 |
| 5,231,714 | A | 8/1993 | Mossbeck | 5/400 |
| 5,289,600 | A | 3/1994 | Schermel | 5/400 |
| 5,469,589 | A | 11/1995 | Steed et al. | 5/400 |
| 5,564,960 | A | 10/1996 | Underhill | 446/8 |
| 5,628,080 | A | 5/1997 | Quintile | 5/663 |
| 5,701,653 | A | 12/1997 | Rupe | 29/432 |
| 5,720,471 | A | 2/1998 | Constantinescu et al. | 267/81 |
| 5,858,508 | A | 1/1999 | Sturtevant | 428/147 |
| 5,953,775 | A | 9/1999 | Mauro | 5/201 |
| 6,108,834 | A | 8/2000 | Mauro | 5/246 |
| 6,125,488 | A | 10/2000 | Vogland et al. | 5/739 |
| 6,292,960 | B1 | 9/2001 | Bowling | 5/308 |
| 6,345,401 | B1 * | 2/2002 | Frydman | 5/636 |
| 6,557,191 | B2 | 5/2003 | Bellows | 5/200.1 |
| 6,615,425 | B1 | 9/2003 | Candell | 5/400 |
| 6,785,920 | B1 | 9/2004 | Amador | 5/308 |
| 6,883,191 | B2 | 4/2005 | Gaboury et al. | 5/201 |
| 7,003,822 | B1 | 2/2006 | Sheehy | 5/201 |
| 2002/0069462 | A1 | 6/2002 | Gaboury | 5/201 |
| 2003/0024045 | A1 | 2/2003 | Bellows | 5/200.1 |
| 2003/0079284 | A1 | 5/2003 | Gaboury | 5/201 |
| 2004/0078897 | A1 | 4/2004 | Gladney | 5/400 |
| 2004/0128761 | A1 | 7/2004 | Gaboury | 5/400 |
| 2005/0028274 | A1 | 2/2005 | Hooper, Jr. | 5/400 |
| 2005/0028275 | A1 | 2/2005 | Hooper, Jr. | 5/400 |
| 2005/0120478 | A1 * | 6/2005 | Hofmann | 5/400 |
| 2005/0278858 | A1 | 12/2005 | Polevoy et al. | 5/663 |

FOREIGN PATENT DOCUMENTS

| | | |
|---|---|---|
| DE | 29618068 | 1/1997 |
| EP | 0954998 | 11/1999 |
| WO | WO-01/05277 | 1/2001 |

* cited by examiner

ADJUSTABLE HEIGHT FOUNDATION

CROSS-REFERENCE TO OTHER PATENT APPLICATIONS

This application is a continuation-in-part of U.S. patent application Ser. No. 10/617,946, filed Jul. 11, 2003 now U.S. Pat. No. 7,017,205, which claims the benefit of U.S. provisional Patent Application No. 60/395,449, filed Jul. 11, 2002, and also claims the benefit of U.S. provisional Patent Application No. 60/518,913, filed Nov. 10, 2003, the contents of all of which are incorporated herein by reference in their entirety.

BACKGROUND OF THE INVENTION

Foundations for mattresses are typically constructed of a frame and a box spring, with the mattress placed on top of the foundation. The foundation provides a support that lifts the mattress off the frame of the bed and positions the mattress relative to the frame at the desired height. The height of the sleep surface above the floor is determined by the combined height of the frame, box spring, and mattress and is typically not adjustable.

Consumers often pay little attention to the height of the foundation they buy and are frequently disappointed when they find out that the foundation is either too high or too low to provide a comfortable height of the sleep surface.

It would therefore be desirable to provide a mattress foundation with a height above the floor that can be easily adjusted by the consumer over at least a limited range.

SUMMARY OF THE INVENTION

The systems and methods described herein include mattress foundations that are adjustable between two or more heights, allowing a consumer to select the height that is appropriate for their bed. The foundation may be designed to fit into a standard bed frame, and may be made of plastic. Ground support members, such as legs, which may also have an adjustable height, may be added to the foundation to construct a mattress foundation and frame combination assembly.

According to one aspect of the invention, a mattress assembly with an adjustable height includes a mattress foundation with a generally planar and essentially rigid top surface having an upper side and a lower side, and an essentially rigid sidewall, having a lower edge, the sidewall extending downwardly substantially along the perimeter of the lower side of the top surface. The mattress assembly further includes a frame assembly with a plurality of ground support members supporting the foundation. The ground support members attach to the sidewall in at least two orientations so as to maintain the top surface of the foundation above ground in a substantially horizontal orientation at at least two different heights.

According to another aspect of the invention, a mattress assembly with an adjustable height includes a first mattress foundation member having a generally planar and essentially rigid top surface with an upper side and a lower side, and a plurality of first spacer members disposed on the lower side. The mattress assembly further includes a second mattress foundation member having a generally planar and essentially rigid top surface with an upper side and a lower side, and a plurality of second spacer members or openings, or both, disposed on the upper side of the second mattress foundation member and adapted to mate with the first spacer members when the first mattress foundation member is placed on top of the second mattress foundation member so that the lower side of the first mattress member faces the upper side of the second mattress member. The height of the assembly can be adjusted by changing an orientation of the first mattress foundation member relative to the second mattress foundation member, for example, by rotating the second mattress foundation member by 180° about an axis perpendicular to the top surface of the second mattress foundation member.

The first spacer members can be irremovably or removably attached to the lower side of the first mattress foundation member. Likewise, the second spacer members can be irremovably or removably attached to the upper side of the second mattress foundation member. Removably attachment can be accomplished with a threaded connection or with an interlocking connection.

The first mattress foundation member can include at least one essentially rigid sidewall, having a lower edge, wherein the sidewall extends downwardly substantially along the perimeter of the lower side of the top surface and overlaps with a side portion of the second mattress foundation member so as to eliminate a gap between the first mattress foundation member and the second mattress foundation member.

The ground support members can be irremovably or removably attached to the foundation, for example, by a mating configuration, such as tongue-and-groove or dovetail, and/or with screws.

The mattress itself can be of rectangular shape, such as a twin, full, queen, Olympic queen, or king mattress, in which case the foundation may also be rectangular in shape and have four sidewalls.

A person of ordinary skill in the art would know, or be able to readily ascertain, that there are various material compositions that may be used for the construction of the mattress foundation or of the combination foundation-frame assembly. For example, the foundation or the combination assembly may be made entirely of plastic. Alternatively, the foundation or the combination assembly may be made, at least in part, of plastic and non-plastic material: examples are plastic on metal; plastic reinforced with metal, carbon, or other fibers; plastic reinforced with resin; and any combination of these and other compositions known to those of ordinary skill in the art.

Furthermore, the plastic used in the construction of the mattress foundation, or of the foundation-frame assembly, may be molded plastic, made according to one or more of the plurality of methods known in the art, such as compression molding, injection molding, gas-assisted injection molding, vacuum molding, low-pressure molding, blow molding, and other molding methods. Those of ordinary skill in the art would know that various types of plastic may be used in the mattress foundation or in the foundation-frame combination assembly; examples include polyurethane, polyethylene, polystyrene, polyvinyl chloride, and polypropylene.

Advantageously, the plastic material can be recyclable, so that the owner of the mattress foundation or foundation-frame combination assembly would be able to dispose of the mattress parts without having to incur the fees that many municipalities charge for disposal of such items of furniture.

BRIEF DESCRIPTION OF THE FIGURES

The foregoing and other objects and advantages of the invention will be appreciated more fully from the following further description thereof, with reference to the accompanying drawings, wherein.

DETAILED DESCRIPTION OF THE ILLUSTRATED EMBODIMENTS

To provide an overall understanding of the invention, certain illustrative embodiments will now be described. These embodiments include, but are not limited to, mattress foundations formed entirely or substantially of molded plastic. However, it will be understood by one of ordinary skill in the art that the systems described herein can be adapted to, for example, foundations formed of other materials, such as wood, extruded and assembled plastic pieces, or composite materials or reinforced plastic (e.g., with glass or carbon fibers, or fillers). All such modifications as would be clear to one of ordinary skill in the art are intended to fall within the scope of the systems described herein.

Figure 1:
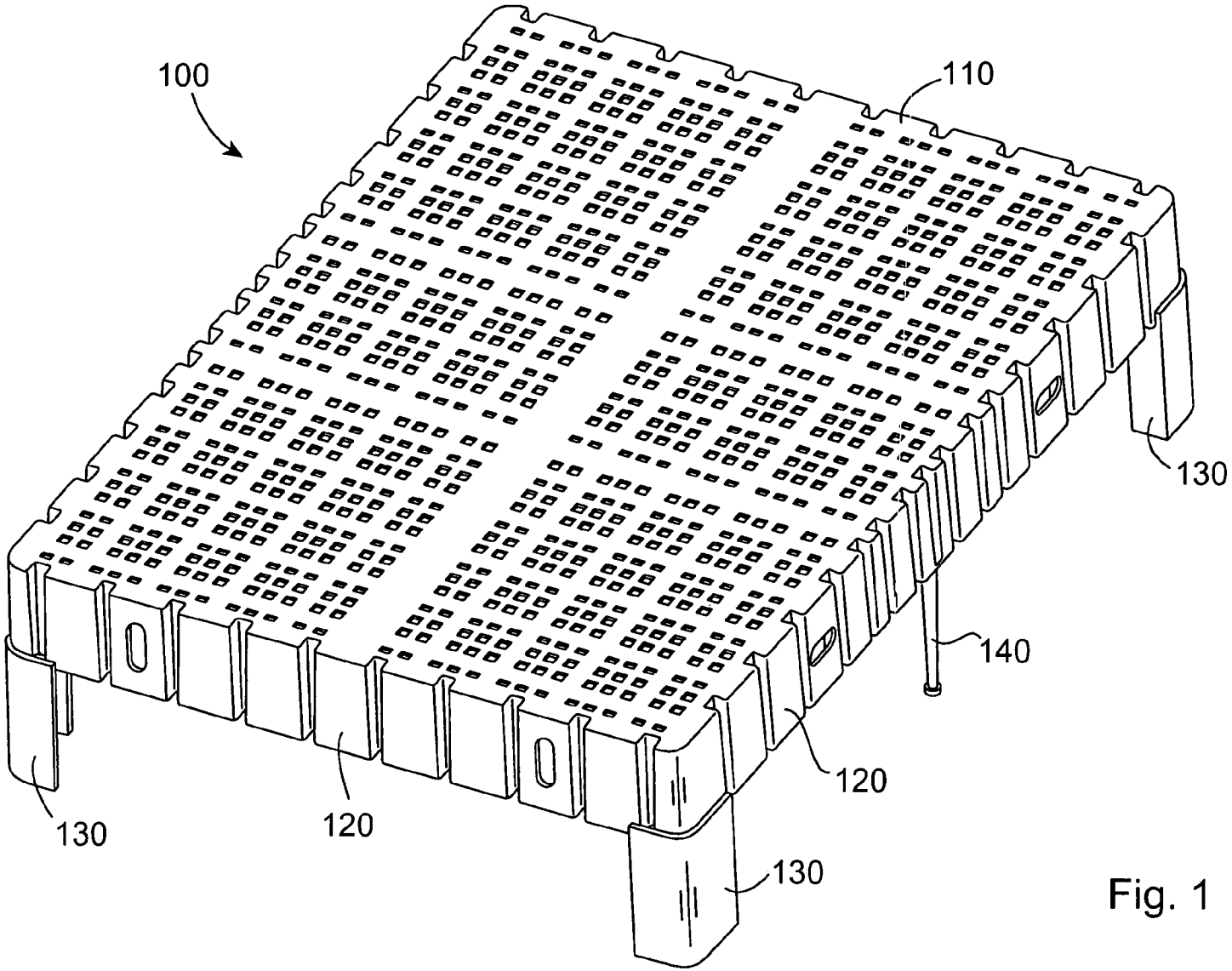
FIG. 1 is a top perspective view of an embodiment of a height-adjustable mattress foundation and frame combination assembly.

FIG. 1 is a top perspective view of a plastic mattress foundation and frame combination assembly. The exemplary illustrated plastic foundation 100 may include a top surface 110 and four sidewalls 120. Attached to, or integrally formed with, the foundation 100 may be four corner supports 130 and optionally supplemental supports 140. The foundation 100 may be used to support a mattress of any type and size, including a foam mattress, as well as mattresses of different constructions including pocketed coil construction, wire spring construction, water bed or any other suitable mattress construction.

The foundation 100 may be formed of any suitable plastic material, including, for example, polyurethane, polyethylene, polystyrene, polyvinyl chloride, polypropylene, or any other moldable plastic that can be formed with sufficient strength to support the weight born by a mattress foundation (including a mattress and one or more human occupants). The foundation may be formed using compression molding techniques such as injection molding, gas-assisted injection molding, vacuum molding, low-pressure molding, or blow molding, in which plastic in some elastic or fluid form is formed into the foundation 100 and permitted to set into a mechanically rigid structure.

The top surface 110 of the foundation 100 may be ribbed as shown in FIG. 1, so that air spaces are formed therein. This reduces weight in areas where less mechanical support is required, or where some pliability is desirable for sleeping comfort on a mattress atop the foundation 100. Certain regions, such as a central portion of the top surface 110, may, by contrast, be formed of an uninterrupted strip of plastic that ties together opposing sidewalls 120. The sidewalls 120 may be corrugated, or contain other non-planar shapes to increase structural rigidity of the sidewalls 120, and the overall foundation 100. Any other truss structure or other structurally enhancing configuration known in the mechanical arts may be used to improve the overall strength and rigidity of the foundation 100.

The corner supports 130 and supplemental supports 140, may be removably attached to the foundation 100 through any conventional mating arrangement, such as a tongue and groove, dovetail, or other functionally equivalent configurations known in the art. According to one embodiment, the corner supports 130 and the supplemental supports 140 may be integrally formed with the foundation 100. While two supplemental supports 140 are shown, it will be appreciated that any number of supports 140 may be used as required by the anticipated load on the mattress foundation 100 and the corresponding inherent strength of the top surface 110 and sidewalls 120. Each supplemental support 140 and corner support 130 may have a cross-sectional shape to increase strength; examples are + shape, X shape, U shape, D shape, H shape, Z shape, C shape, V shape, M shape, B shape, T shape, circular shape, elliptical shape, L shape, heart shape, and any combination of these.

Figure 2:
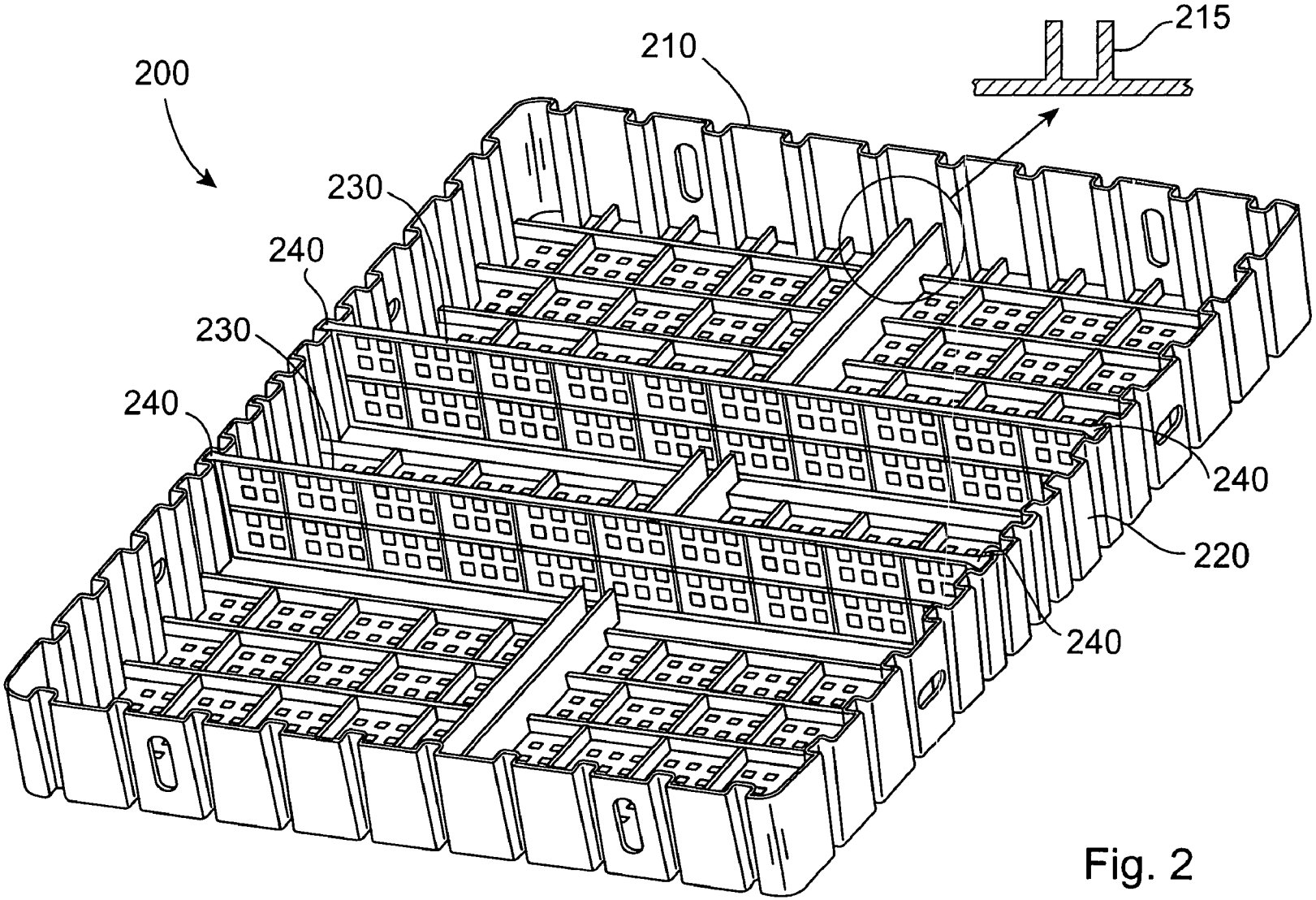
FIG. 2 is a bottom perspective view of the mattress foundation of FIG. 1.

FIG. 2 is a bottom perspective view of a plastic mattress foundation. As shown in FIG. 2, the foundation 200 may include a bottom surface 210 with a cross-sectional profile 215 and one or more sidewalls 220. One or more braces 230 may be connected to, or integrally formed with the foundation 200 such that opposing sidewalls 220 are interconnected to structurally support the foundation 200. The foundation 200 may generally be similar to the foundation 100 described above with reference to FIG. 1.

The sidewalls 220 may include one or more grooves 240 adapted to receive a corresponding tongue on each of the braces 230. The grooves 240 may be designed to allow for a snap-on, snap-off attachment of the braces to the foundation, thereby easing the assembly or disassembly of the foundation. Furthermore, the grooves 240 may be shaped to prevent undesirable outward deflection of the sidewalls under load weights, for example as a dovetail. Each brace 230 may include non-planar reinforcing structures and air spaces as described above generally with reference to the foundation 100 of FIG. 1.

The bottom surface 210 of the foundation 200 may include reinforcing structures to structurally reinforce the foundation 200 so as to properly support a mattress and one or more occupants of the mattress. One exemplary structure is perpendicular fins, as shown in the cross-sectional profile 215. Other reinforcing structures including trusses, additional braces, and so forth, may also be used.

The use of the support braces 230, fins (shown in the cross-sectional profile 215), trusses, and other non-planar reinforcing support structures is justified for more than one reason. Unlike a mattress foundation that sits directly on a flat surface, and the lower edges of whose sidewalls serve as mechanical supports that resist twisting, bending, and undesirable deflection, a mattress foundation that rests on a set of ground support members (such as corner supports 130 and/or supplementary supports 140) disposed at discrete points along the lower edge of the sidewalls 120, is subject to undesirable mechanical forces of twisting, bending, and deflection that may be suppressed by adding structural reinforcement.

Figure 3:
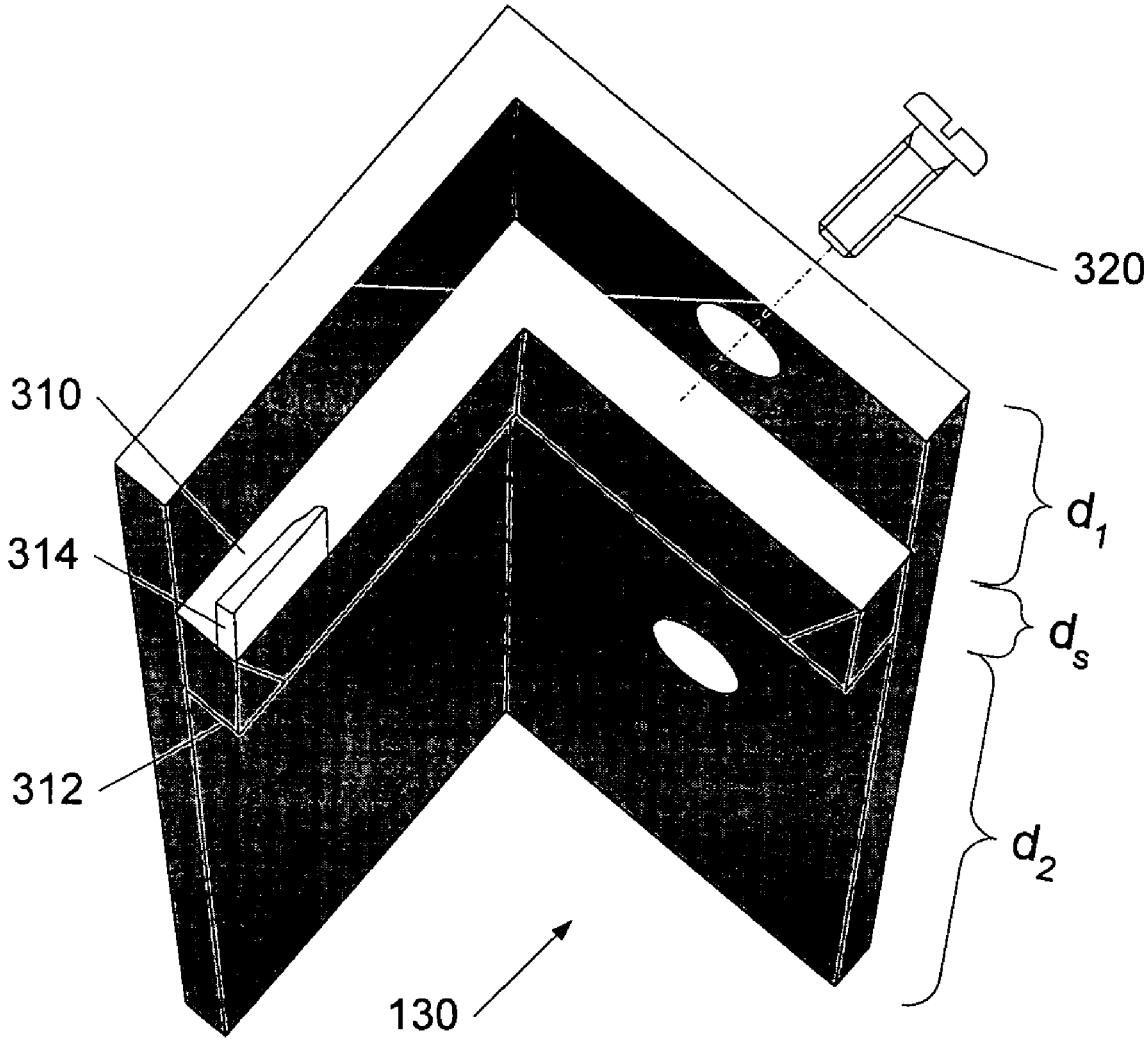
FIG. 3 shows an exemplary height-adjustable corner support to be used with the mattress foundation of FIG. 1.

FIG. 3 shows a removable corner support 130 that can be used to adjust the height of foundation 100. If foundation 100 is placed on corner support 130 in the orientation depicted in FIG. 3, then the bottom of the sidewalls 120 would rest on the upper surface 310, thereby raising the bottom above the floor by a distance ($d_s$+$d_2$). When the corner support is inverted, the bottom of the sidewalls 120 would rest on the lower surface 312, thereby raising the bottom above the floor by a distance ($d_s$+$d_1$). The corner support 130 can be secured to the foundation 100, for example, with fasteners, such as screws 320, and/or by providing lips 314 on the top and/or bottom surfaces 310, 312 (only the upper lip 314 is shown partially cut away in FIG. 3) which could secure the corner support 130 to the foundation 100 by friction. Other attachment means known in the art can also be used, A person skilled in the art would be able to similarly adapt the optional supplementary supports 140 to enable commensurate height adjustment.

Figure 4:
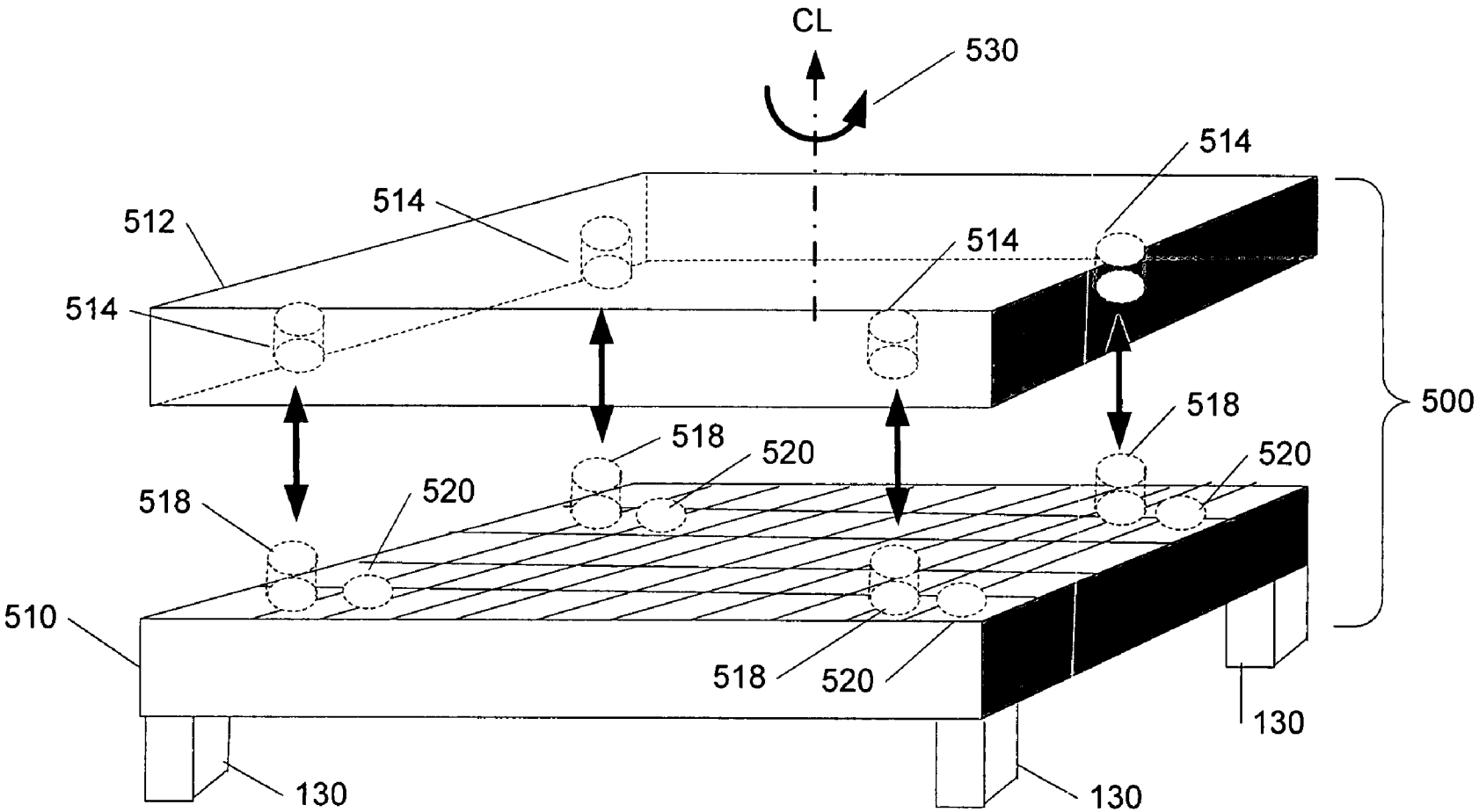
FIG. 4 depicts an exploded view of another embodiment of a height-adjustable mattress foundation and frame combination.

FIG. 4 depicts another embodiment of a foundation that is adjustable between two or more different heights. Specifically, a foundation 500 depicted in FIG. 4 includes a lower portion 510 and an upper portion 512. The lower portion 510 may be a plastic foundation similar to the foundation 100 described above with reference to FIGS. 1 and 2 and capable of supporting a mattress thereon. As before, the foundation 500 may include legs 130, that can be height-adjustable, as shown in FIG. 3, and the foundation may also fit within a bed frame (not shown). Both the upper portion 512 and the lower portion 510 of foundation 500 may also include the braces, fins, trusses, and other structural reinforcement described above for the foundation 100, which have been omitted from FIGS. 4–6 for sake of clarity.

Figure 5:
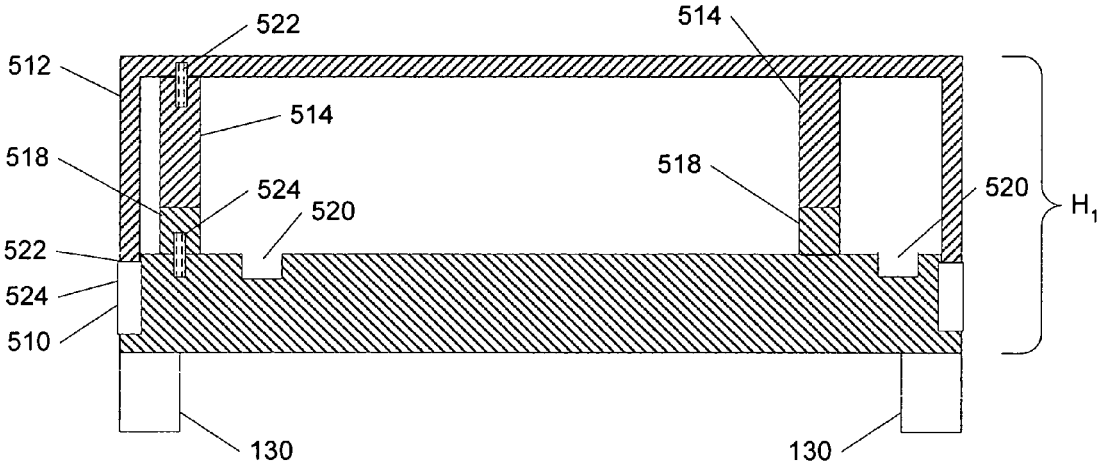
FIG. 5 depicts the height-adjustable mattress foundation and frame combination of FIG. 4 at a first height.
Figure 6:
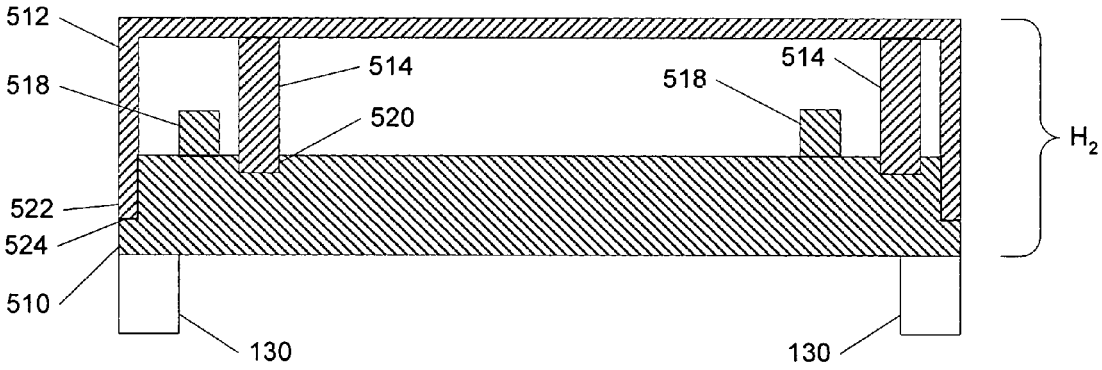
FIG. 6 depicts the height-adjustable mattress foundation and frame combination of FIG. 4 at a second height.

As seen in FIG. 4, and more particularly in FIGS. 5–6, the upper portion 512 may be seated on top of the lower portion 510 to achieve, depending upon its orientation, two additional selected heights. To this end, the lower portion 510 of the foundation includes in one embodiment a set of posts 518 and optional holes 520 that, depending upon the rotational orientation 530 of the upper portion 512, will mate against and buttress a set of posts 514 that are positioned in an interior space of the upper portion 512. For sake of clarity, only four posts 514, 518 and holes 520 are shown on each of the respective upper and lower portions 512, 510, although additional posts and/or holes could be provided depending, for example, on the rigidity of the upper and lower portions 512, 510 and the size of the mattress.

FIG. 5 depicts a cross-sectional view of the foundation 500 in a first height-adjusted position. As seen in FIG. 5, posts 514 rest on posts 518, providing an overall height $H_1$ of the foundation 500, excluding the (adjustable) height of the corner supports 130. To provide lateral stability and registration of the upper portion 512 on top of the lower portion 510, the upper portion 512 can have a lip 522 extending at least partially around the lower portion 510 and capable of engaging with a recess or shoulder provided in the lower portion 510. Alternatively or in addition, for example, at least the post 518 can include a socket or pin (not shown) that engages with a mating configuration disposed in the post 518 so as to prevent lateral motion and registration between the lower portion 510 and the upper portion 512.

Referring now to FIG. 6, when the upper portion 512 is rotated from the position indicated in FIG. 5 by 180° relative to the lower portion 510, as indicated by arrow 530 in FIG. 4, then the posts 514 fit into the holes 520 so that the upper portion 512 and the lower portion 510 have a combined height $H_2$ which is less than $H_1$.

Optionally, additional height adjustments can be made possible by supplying inserts (not shown) that can be inserted in holes 20, thereby reducing the depth of the holes. Alternatively or in addition, posts 514 and/or 518 can be made removable (for example, by screwing them into the corresponding upper portion 512 and lower portion 510, as indicated by reference numerals 522, 524, or by an interlocking mechanism), so that the posts 514, 518 can be, for example, interchanged with each other and/or replaced by other additionally supplied posts, thus enabling the user to obtain other height combinations. If the threaded attachment 522, 524 is made sufficiently sturdy, a continuous height adjustment may also be contemplated by partially threading the posts 514, 518 into the corresponding threads 522, 524. In a further embodiment, the lower portion 510 may be used independently of the upper portion 512 to provide a third, lower height for the foundation. In this practice, the upper portion may be stored away until and if it is required for use with another mattress. In this optional embodiment, the upper surface of the lower portion 510 may have a sufficient number of posts to provide adequate surface area to support the mattress and users.

Figure 7A:
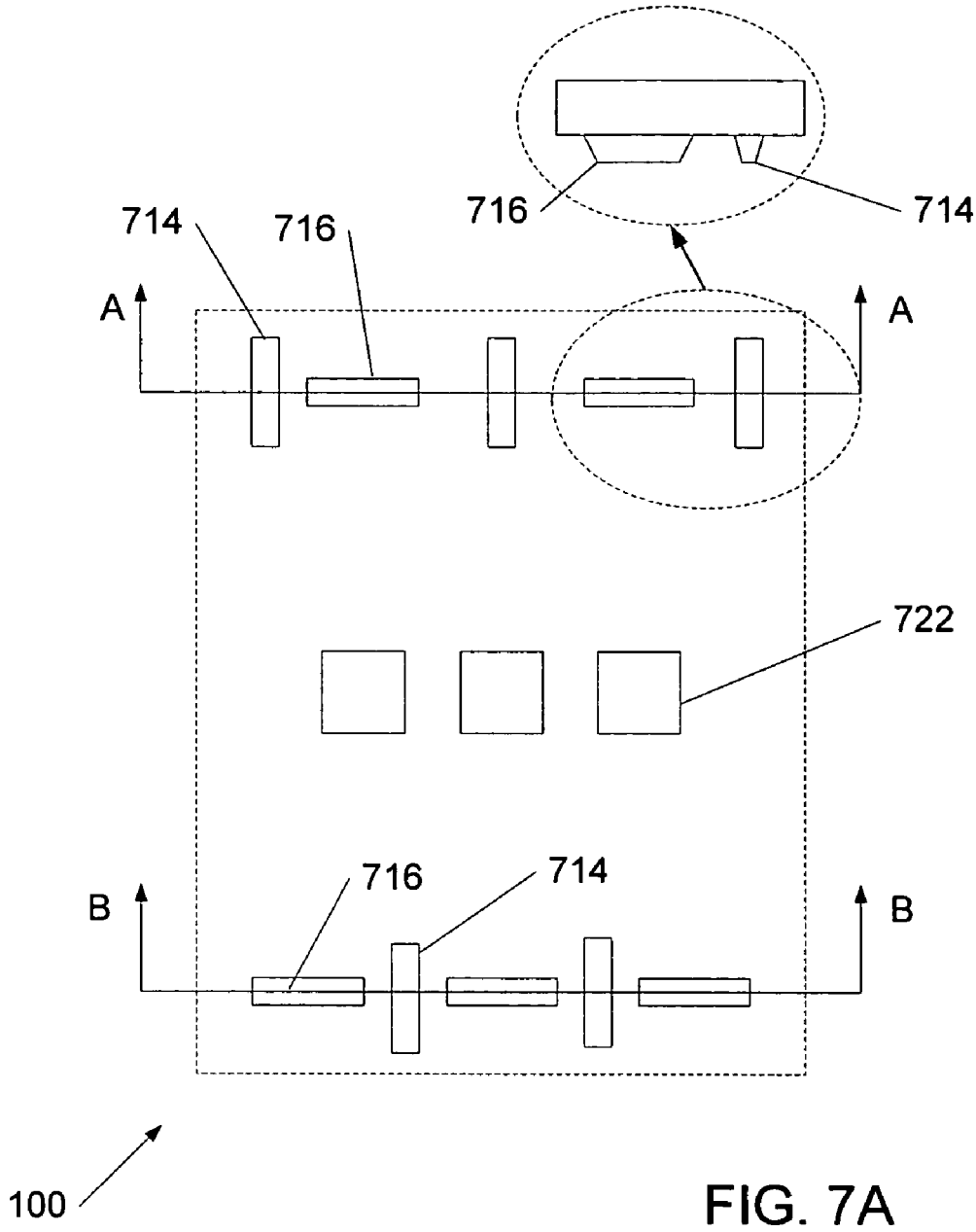
FIG. 7A is a top view of another embodiment of a height-adjustable mattress foundation.
Figure 8A:
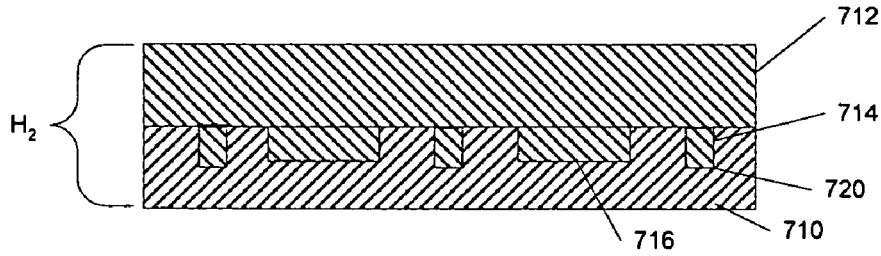
FIGS. 8A and B show a cross-section taken along line A—A (FIG. 8A) and line B—B (FIG. 8B) with the mattress foundation at a first height.
Figure 8B:
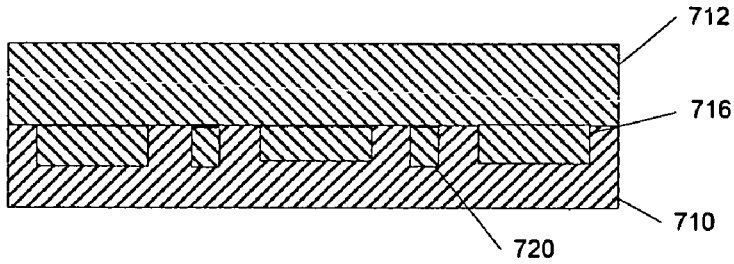

FIG. 7A shows a top view of another embodiment of a height-adjustable mattress foundation 100. In this embodiment a single molded plastic support is employed to provide a foundation that can achieve three heights. A first height using only one of the pieces, and two other heights, each associated with a different relative orientation of the two supports. In this optional embodiment, the pieces are stackable and nest together to provide for easy storage. For a better understanding of the invention, cross-sectional views are depicted in FIGS. 8A and 8B, with the mattress foundation at a first (lower) height $H_2$, and in FIGS. 9A and 9B, with the mattress foundation at a second (greater) height $H_2$. For purpose of height adjustment, an upper portion 712 of mattress foundation 100 includes differently shaped and/or oriented projections 714, 716, with the lower portion 710 of mattress foundation 100 having corresponding recesses or openings schematically indicated by reference numeral 720. As shown in the inset of FIG. 7A, the projections/recesses can be beveled to facilitate engagement therebetween. Additional support can be provided in the center of the mattress foundation 100, which can also have projections/recesses to support the height adjustment functionality described below.

In a different configuration of the projections/recesses 714, 716, projections can alternate with recesses in the transverse direction, which enables a greater difference between the achievable heights $H_1$ and $H_2$.

Figure 7B:
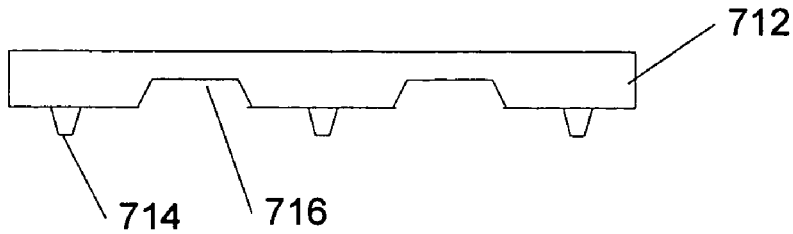
FIG. 7B shows another embodiment of projections/recesses for height adjustment.

Referring now to FIG. 8A, which is a cross-sectional view taken along the line A—A of FIG. 7A, differently shaped projections 714 disposed on the bottom surface of upper portion 712 (oriented, for example, in the longitudinal and transverse direction, respectively, of the mattress foundation 100) engage with mating recesses/openings 720 disposed in the top surface of lower portion 710. Likewise, as seen in FIG. 8B, which is a cross-sectional view taken along the line B—B of FIG. 7, projections 714, 716 disposed on the bottom surface of upper portion 712 also engage with mating recesses/openings 720 disposed in the top surface of lower portion 710. However, the projections 714, 716 and mating recesses in FIG. 8A have different orientations from those of FIG. 8A. The bottom surface of upper portion 712 is in the exemplary embodiment resting on the top surface of lower portion 710, providing a mattress foundation 100 at a first height $H_2$.

Figure 9A:
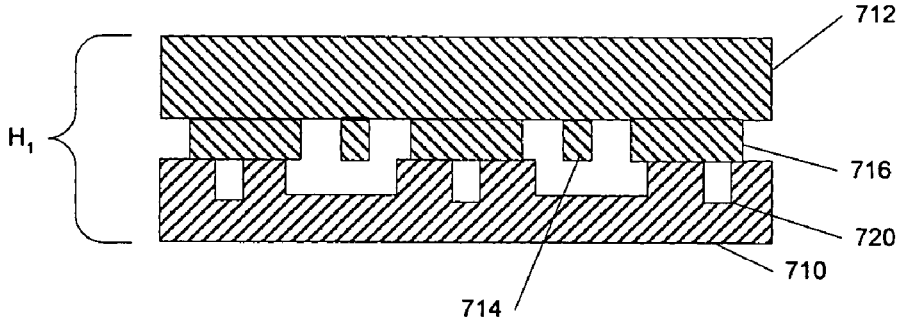
FIGS. 9A and B show a cross-section taken along line A—A (FIG. 9A) and line B—B (FIG. 9B) with the mattress foundation at a second height.
Figure 9B:
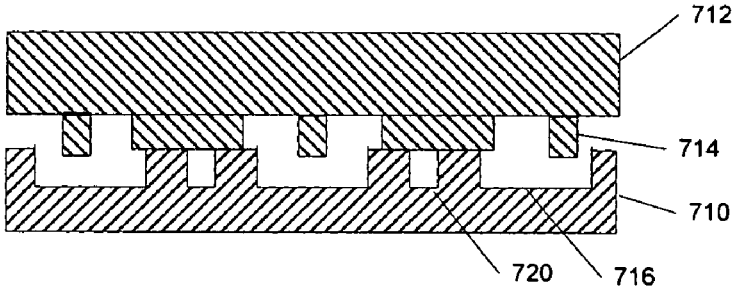

Referring now to FIG. 9A, when the upper portion 712 is rotated by 180° with respect to the lower portion 710, the projections 714, 716 are no longer aligned with the recesses/openings in the lower portion 710, so that the projections 712, 714 now rest on the top surface of lower portion 710 (instead of inside the recesses/openings), resulting in a second height $H_1$ of the mattress foundation 100 which is greater than the height $H_2$. The mattress foundation 100 is capable of supporting a load in excess of 600 kg even at the greater height due to the substantial contact area between the upper and lower portions 710 and 712.

It will be understood that the depicted configurations shapes and orientations are only examples, and that other dimensions, shapes and orientations of the projections and recesses can be used.

The foundation 100, 500 may be formed of any suitable material, including wood, metal foam and preferably plastic, such plastic material, including, for example, polyurethane, polyethylene, polystyrene, polyvinyl chloride, polypropylene, or any other moldable plastic that can be formed with sufficient strength to support the weight born by a mattress foundation (including a mattress and one or more human occupants). The foundation 100, 500 may be formed using compression molding techniques such as injection molding, gas-assisted injection molding, vacuum molding, low-pressure molding, or blow molding, in which plastic in some elastic or fluid form is formed into the foundation 100, 500 and permitted to set into a mechanically rigid structure.

Those of ordinary skill in the art will know, or be able to ascertain using no more than routine experimentation, many equivalents to the embodiments and practices described herein. Accordingly, it will be understood that the invention is not to be limited to the embodiments disclosed herein, but is to be interpreted as broadly as allowed under the law, according to the following claims.

We claim:

1. A mattress assembly having an adjustable height, comprising:

a. a first mattress foundation member comprising:

i. a generally planar and essentially rigid top surface having an upper side and a lower side; and ii. a plurality of first spacer members disposed on the lower side; and b. a second mattress foundation member comprising:

i. a generally planar and essentially rigid top surface having an upper side and a lower side; and ii. a plurality of second spacer members or openings, or both, disposed on the upper side of the second mattress foundation member and configured to mate with the first spacer members when the first mattress foundation member is placed on top of the second mattress foundation member so that the lower side of the first mattress member faces the upper side of the second mattress member to define a first height disposed in a first orientation;

wherein at least a second height of the assembly different from said first height is defined by at least a second orientation of the first mattress foundation member relative to and overlying the second mattress foundation member and different from said first orientation.

2. The assembly of claim 1, wherein the first spacer members are irremovably attached to the lower side of the first mattress foundation member.

3. The assembly of claim 1, wherein the first spacer members are removably attached to the lower side of the first mattress foundation member.

4. The assembly of claim 3, wherein the first spacer members are attached with a threaded connection.

5. The assembly of claim 3, wherein the first spacer members are attached with a interlocking connection.

6. The assembly of claim 1, wherein the second spacer members are irremovably attached to the upper side of the second mattress foundation member.

7. The assembly of claim 6, wherein the second spacer members are removably attached to the upper side of the second mattress foundation member.

8. The assembly of claim 7, wherein the second spacer members are attached with a threaded connection.

9. The assembly of claim 7, wherein the second spacer members are attached with a interlocking connection.

10. The assembly of claim 1, wherein a depth of the openings is adjustable.

11. The assembly of claim 1, wherein the first mattress foundation member comprises at least one essentially rigid sidewall, having a lower edge, the sidewall extending downwardly substantially along the perimeter of the lower side of the top surface and overlapping with a side portion of the second mattress foundation member so as to eliminate a gap between the first mattress foundation member and the second mattress foundation member.

12. The mattress assembly of claim 1, wherein the orientation of the first mattress foundation member relative to the second mattress foundation member is changed by rotating the second mattress foundation member by 180° about an axis perpendicular to the top surface of the second mattress foundation member.

13. The mattress assembly of claim 1, further comprising a frame assembly with a plurality of ground support members supporting the foundation.

14. The mattress assembly of claim 13, further comprising at least one essentially rigid sidewall having a lower edge, the sidewall extending downwardly substantially along a perimeter of the lower side of the top surface of the second mattress foundation member, wherein the ground support members attach to said at least one sidewall in at least two orientations so as to maintain the top surface of the foundation above ground in a substantially horizontal orientation at at least two different heights.

* * * * *